United States Patent [19]

Hofmann

[11] Patent Number: 5,020,981

[45] Date of Patent: Jun. 4, 1991

[54] FUEL INJECTION PUMP FOR INTERNAL COMBUSTION ENGINES

[75] Inventor: Eberhard Hofmann, Kirchberg/M, Fed. Rep. of Germany

[73] Assignee: Robert Bosch GmbH, Stuttgart, Fed. Rep. of Germany

[21] Appl. No.: 178,785

[22] Filed: Mar. 30, 1988

Related U.S. Application Data

[63] Continuation of Ser. No. 404,957, Aug. 4, 1982, abandoned.

[30] Foreign Application Priority Data

Sep. 26, 1981 [DE] Fed. Rep. of Germany ..... 3138409

[51] Int. Cl.[5] ..... F02M 59/48

[52] U.S. Cl. ..... 417/501; 417/570

[58] Field of Search ..... 417/501, 570, 494, 499

[56] References Cited

U.S. PATENT DOCUMENTS 2,544,561 3/1951 Meyer ..... 417/494 X
2,612,840 10/1952 Lasley ..... 417/499
2,612,841 10/1952 Lasley ..... 417/501
2,953,992 9/1960 Bartholomaus ..... 417/501

FOREIGN PATENT DOCUMENTS 269560 6/1968 Austria ..... 417/499
1178759 5/1959 France ..... 417/494

*Primary Examiner*—Leonard E. Smith
*Attorney, Agent, or Firm*—Edwin E. Greigg; Ronald E. Greigg

[57] ABSTRACT

A fuel injection pump for internal combustion engines which has at least one pumping element inserted in a reception bore of a pump housing made of light metal. The pumping element substantially comprises a cylinder sleeve, in the cylinder bore of which a pump piston is slidably guided, and a pressure valve. The pump piston has at least one oblique control edge and is rotatable in order to vary the supply quantity. The valve body of the pressure valve is disposed in an extension of the cylinder bore. The cylinder sleeve and the pressure valve are tightly fastened into the housing by means of a screw nipple. The screw nipple is threaded into a steel plate, which is tightly fastened against the upper end face of the pump housing by means of screws.

3 Claims, 1 Drawing Sheet

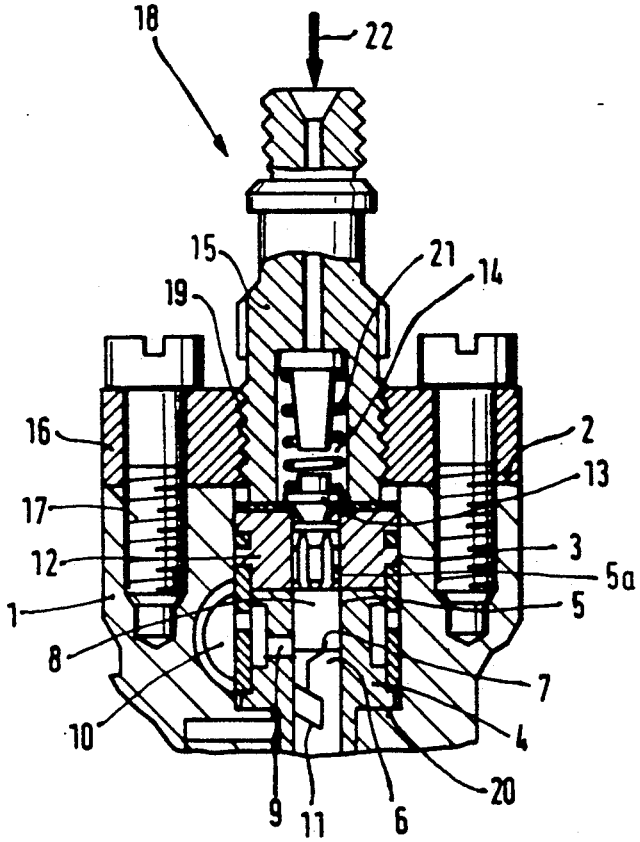
18
22
15
21
14
19
16
2
13
17
3
12
5a
1
5
8
7
10
4
20
9
11
6

FUEL INJECTION PUMP FOR INTERNAL COMBUSTION ENGINES

This is a file wrapper continuation application of U.S. patent application Ser. No. 404,957, filed Aug. 4, 1982, now abandoned.

BACKGROUND OF THE INVENTION

This invention is based on a multi-cylinder fuel injection pump for internal combustion engines.

A fuel injection pump of this kind is known from U.S. Pat. Nos. 3,677,256; 3,885,895; and 4,222,717. In U.S. Pat. No. 3,885,895 the cylinder sleeves guiding the pump piston are embodied as flanged sleeves, the securing flanges being screwed tightly against the upper end face of the pump housing. This securing arrangement is very laborous and is expensive to fabricate; however, such a pump does permit higher injection pressures than the other prior art patents noted. In some of the prior art pumps, the diameter of the screw-in thread for a screw nipple determines the maximum possible screw-insertion diameter of both the pressure valve body and the cylinder sleeves. As a result, this leaves relatively narrow bearing surfaces for the cylinder sleeves, which in turn limits the axial forces of the screw nipples and thus the maximum allowable pump load or pumping output.

From U.K. Patent 827,678, a further fuel injection pump is known, the pump housing of which comprised two parts, the upper part being of steel and carrying the cylinder sleeves with the pump piston. This steel upper part is very heavy and also quite expensive.

OBJECT AND SUMMARY OF THE INVENTION

The fuel injection pump according to the invention has a advantage over the prior art in that it requires less effort and is less expensive to manufacture. The use of a steel plate according to the invention means that the diameter for the pressure valve bodies and the cylinder sleeves can furthermore be increased while retaining the same thread diameter of the screw nipple, as a result of which the abutment faces of the cylinder sleeves in the light-metal housing are also increased in area. As a result, a tightening moment of each screw nipple which is sufficient for high-pressure sealing purposes can be attained, without the areal pressure at the seat of the cylinder sleeve exceeding permissible limits.

The invention will be better understood and further objects and advantages thereof will become more apparent from the ensuing detailed description of one preferred embodiment taken in conjunction with the drawing.

BRIEF DESCRIPTION OF THE DRAWINGS

The sole FIGURE of the drawing is a schematic illustration of a cross section taken through the upper part of the fuel injection pump according to the invention, which is described in detail below.

DESCRIPTION OF THE PREFERRED EMBODIMENT

The fuel injection multi-cylinder pump, shown only in part, has a pump housing 1 of light metal, which includes a plurality of bores 3, each of which receives a cylinder sleeve 4 extending perpendicular to the camshaft and beginning at the upper end face 2 of the pump housing. Each cylinder sleeve 4 has a cylinder bore 5, in which a pump piston 6 is slidably guided. At its end remote from the drive mechanism and defined by one end 7 of the pump piston 6, the cylinder bore 5 has a pump work chamber 8, which is supplied with fuel during the suction stroke from a suction chamber 10 of the pump housing 1 via a control bore 9 in the wall of the cylinder sleeve 4. Should only one bore be provided this control bore 9 serves simultaneously as a return flow bore for the fuel, which flows back out of the pump work chamber 8 into the suction chamber 10 in a known manner during the compression stroke of the pump piston 6—and in fact at the end of the effective compression stroke—by means of the cooperation of the control bore 9 with an oblique control edge 11 on the pump piston 6. The return flow quantity of fuel is dependent on the relative position of the oblique control edge 11 and the control bore 9. This position is determined by the rotary position of the pump piston 6, which is rotatable via a known adjusting device (not shown) in order to vary the supply quantity.

A pressure valve body 12 adjoins the cylinder sleeve 4 an includes an axial bore **5*a* having the same longitudinal axis diameter as the pump work chamber 8. A nipple 15 secures the pressure valve body 12 in a tight fit against the upper end of the cylinder sleeve 4 and includes a spring chamber 14 that has a greater diameter than the bore 5*a*, which receives a valve member 13 that seats on a valve seat formed by the upper end of the bore 5*a* and the valve body 12. The movable valve member 13 includes a portion that extends into the bore 5*a* of the pressure valve body 12. A heavy metal plate 16 such as steel is placed over the entire end face 2 of the pump housing 1 and is secured tightly to the pump housing 1 with screws 17 which are received in suitable threaded bores. The steel plate 16 includes as many threaded apertures as there are cylinder sleeves in which each threaded aperture includes as many pipe fitting threads 19 as there are threads on the screw nipple 15 of a pumping element 18, which is threaded into each of the apertures, and the thickness of the steel plate is determined by the number of threads required for the load bearing thread length of the screw nipple. Each pressure valve body 12 and associated cylinder sleeve 4 are tightened in a high-pressure-sealed manner with the cylinder sleeve tightened against an inner shoulder 20 at the transition between the cylinder sleeve 4 an the pump housing 1 by means of the screw nipple 15, which is threaded into the pipe fitting threads 19 of the steel plate 16. A pressure line 22 indicated only by an arrow, which carries the fuel in a known manner to an injection nozzle (not shown), is connected to the screw nipple 15 in which the spring chamber 14 receives a spring 21 that stresses the movable valve member 13 toward the valve seat. By means of using the steel plate 16, into which each of the screw nipples 15 holding the pumping elements 18 are threaded, it is possible to enlarge the contact surface area of the inner shoulder 20**, so that sufficient tightening moment for high-pressure sealing can be attained, without having to increase the total length of the pump housing.

The foregoing relates to a preferred exemplary embodiment of the invention it being understood that other embodiments and variants thereof are possible within the spirit and scope of the invention, the latter being defined by the appended claims.

What is claimed and desired to be secured by Letters Patent of the United States is:

1. A multi-cylinder fuel injection pump for internal combustion engines comprising a pump housing made of a light metal, said pump housing including a plurality of reception bores therein, each of said reception bores including a large diameter portion and a small diameter portion formed by a shoulder, a plurality of pumping elements inserted one each into each of said reception bores of said pump housing, each of said pumping elements comprising a cylinder sleeve having a large diameter portion and a smaller diameter portion approximately the same as said large and smaller diameter portions of said reception bore and a shoulder that seats on said shoulder of said reception bore, each of said cylinder sleeves including an axial cylinder bore, a pressure valve body (12) having an outer diameter substantially the same diameter as said cylinder sleeve and an axial bore therein having the same longitudinal axis as said axial cylinder bore and positioned in said reception bore axially juxtaposed said cylinder sleeve, a steel plate tightly secured to an upper end face of said light metal housing to form a part of said pump housing, said steel plate including a plurality of aligned threaded apertures, each of said threaded apertures being in axial alignment with each of said plurality of said reception bores with said threaded apertures having a smaller diameter than said larger diameter portion of said reception bores, a threaded nipple threaded into each of said threaded apertures in said steel plate, whereby each said cylinder sleeve and said pressure valve are clamped together and tightly fastened axially in one of said reception bores between said shoulder of said reception bore and an inner end of one of said threaded nipples by means of said threaded nipples threaded into said threaded apertures in said steel plate, the thickness of said steel plate being substantially equal to the length of said threads on said nipple, said threaded nipple including an axial spring chamber, a movable value member having a large portion in said spring chamber and a small extension extending into said bore of said pressure valve body, a valve seat on an upper end of said pressure valve body, a spring in said spring chamber that forces said movable valve member against said valve seat, and a pump piston slidably guided in said cylinder bore provided with at least one oblique control edge and rotatable to vary the fuel supply quantity for said fuel combustion engine.

2. A fuel injection pump as set forth in claim 1, which includes a work chamber in said cylinder sleeve bore, a suction chamber in said housing, and at least one bore that extends from said work chamber to said suction chamber.

3. A fuel injection pump as set forth in claim 1, in which said thickness of said steel plate is such that a proper tightness of said cylinder sleeve and said pressure valve body is established on assembly.

* * * * *